US009053847B2

(12) United States Patent
Zhou et al.

(10) Patent No.: US 9,053,847 B2
(45) Date of Patent: Jun. 9, 2015

(54) IRON-BASED AMORPHOUS ALLOY BROAD RIBBON AND ITS MANUFACTURING METHOD

(71) Applicant: Advanced Technology & Materials Co., Ltd., Beijing (CN)

(72) Inventors: Shaoxiong Zhou, Beijing (CN); Guodong Liu, Beijing (CN); Wenzhi Chen, Beijing (CN); Lidong Ding, Beijing (CN); Jian Wang, Beijing (CN); Quan Li, Beijing (CN); Zhiying Zhang, Beijing (CN); Pei Zhao, Beijing (CN)

(73) Assignee: ADVANCED TECHNOLOGY & MATERIALS CO., LTD., Beijing (CN)

( * ) Notice: Subject to any disclaimer, the term of this patent is extended or adjusted under 35 U.S.C. 154(b) by 0 days.

(21) Appl. No.: 14/348,882

(22) PCT Filed: Sep. 27, 2012

(86) PCT No.: PCT/CN2012/082137

§ 371 (c)(1),
(2) Date: Mar. 31, 2014

(87) PCT Pub. No.: WO2013/044820

PCT Pub. Date: Apr. 4, 2013

(65) Prior Publication Data

US 2014/0283957 A1 Sep. 25, 2014

(30) Foreign Application Priority Data

Sep. 29, 2011 (CN) ..... 2011 1 0293417

(51) Int. Cl.

| | |
|---|---|
| ***C22C 45/02*** | (2006.01) |
| ***C21D 8/12*** | (2006.01) |
| ***H01F 1/153*** | (2006.01) |
| ***C22C 45/00*** | (2006.01) |
| ***C22C 1/00*** | (2006.01) |
| ***B22D 11/06*** | (2006.01) |

(52) U.S. Cl.

CPC ..... *H01F 1/15308* (2013.01); *C22C 45/00* (2013.01); *H01F 1/15341* (2013.01); *C22C 1/00* (2013.01); *C21D 8/1211* (2013.01); *B22D 11/0611* (2013.01)

(58) Field of Classification Search

None

See application file for complete search history.

(56) References Cited

U.S. PATENT DOCUMENTS 4,842,081 A * 6/1989 Parant ..... 173/186
5,908,068 A 6/1999 Kurokawa et al.

(Continued)

FOREIGN PATENT DOCUMENTS

CN 1308764 A 8/2001
CN 102314985 A 1/2012

*Primary Examiner* — George Wyszomierski

(74) *Attorney, Agent, or Firm* — Muncy, Geissler, Olds & Lowe, P.C.

(57) ABSTRACT

The invention belongs to the technical field of rapid solidification of amorphous alloy and concretely relates to an iron-based amorphous alloy broad ribbon, wherein the width is 220-1000 mm, the thickness is 0.02-0.03 mm, the transversal thickness deviation is smaller than +/−0.002 mm, the lamination factor is larger than 0.84, the saturation magnetic-flux density is larger than 1.5 T, the iron loss is smaller than 0.20 W/kg under the conditions that the frequency is 50 Hz and the maximum magnetic-flux density is 1.3 T, and the exciting power is smaller than 0.50 VA/kg. The invention also relates to a manufacturing method of the broad ribbon, and a single-roll quenching method is adopted, wherein the width of a nozzle slot is 0.4-0.7 mm, the transversal width deviation of the nozzle slot is smaller than +/−0.05 mm, the transversal flatness deviation of a cooling roll (4) is smaller than 0.02 mm, and the surface roughness Ra is smaller than 0.0005 mm.

11 Claims, 2 Drawing Sheets

(56) References Cited

U.S. PATENT DOCUMENTS 6,299,989 B1 * 10/2001 De Cristofaro et al. ..... 428/637
7,282,103 B2 * 10/2007 Sakamoto et al. ..... 148/305
2011/0036532 A1 * 2/2011 Sato ..... 164/463
2012/0127620 A1 * 5/2012 Herzer ..... 361/93.1

* cited by examiner

IRON-BASED AMORPHOUS ALLOY BROAD RIBBON AND ITS MANUFACTURING METHOD

TECHNICAL FIELD

The present invention belongs to the technical field of rapid solidification of amorphous alloy, concretely relates to an iron-based amorphous alloy broad ribbon and the manufacturing method, especially an iron-based amorphous alloy broad ribbon with width of 220~1000 mm and manufacturing method.

PRIOR ART

As a kind of soft magnetic materials, iron-based amorphous alloy has excellent electromagnetic properties. It can greatly reduce the operation energy consumption of transformers when used as iron cores in the distribution transformers. Therefore, it is widely used in the field of distribution transformer. For instance, Hitachi Metals Ltd.'s iron-based amorphous alloy ribbon products (Metglas2605SA1) include three width specifications—142 mm, 170 mm and 213 mm—to allow users to manufacture the iron cores of the transformers at different sizes.

The iron-based amorphous alloy ribbon with a maximum width of 213 mm in the prior art may be used to manufacture distribution transformer with capacity less than 2000 kVA, but is difficult to make distribution transformers with larger capacity. This is because that, the iron core structure of amorphous alloy distribution transformers is designed through optimization based on capacity of transformers and width of amorphous alloy ribbon; if distribution transformers with capacity larger than 2000 kVA is designed and manufactured with the existing specification of amorphous alloy ribbon, the stack thickness of the amorphous iron core will be increased to a large extent causing the section dimension of the amorphous alloy iron core deviating from reasonable range obviously, which is disadvantageous technically or economically. In other words, for distribution transformer with capacity larger than 2000 kVA, wider amorphous alloy ribbons are needed to take advantage of amorphous alloy. In consideration of the benefit of amorphous alloy distribution transformers in the aspect of energy conservation, it's urgently expected to use amorphous alloy as iron core materials in large-sized transformers. Therefore there is a huge demand for the iron-based amorphous alloy broad ribbon with width larger than 220 mm.

As a new kind of materials developed during the last few decades, amorphous alloy is generally manufactured with rapid solidification technology, which is also named "single-roll quenching method". The typical manufacturing method is as below: raw materials with special compositions are melted into molten alloy, and then the melt flows onto a high-speed rotating cooling roll with a good heat conductivity metal through a narrow nozzle slot having a width below 1 mm; the melt spreads on the surface of the circumference surface of the cooling roll and is fast cooled down at the cooling rate of $10^{6\circ}$ C./sec to form a continuous metal thin ribbon with a thickness of approx. 0.03 mm. The process is schematically shown in FIG. 1.

During manufacturing of amorphous alloy ribbons, the dimension of the nozzle slot determines the flow of the melt. Therefore, the transversal dimension uniformity of nozzle slot is one of key factors to transversal thickness uniformity of amorphous alloy broad ribbon. For example, US patent US19970864892 (entitled "Method of manufacturing a wide metal thin strip") provides a nozzle structure for manufacturing amorphous alloy broad ribbon. According to a special appearance design of the nozzle, the amorphous alloy broad ribbon with the maximum width of 200 mm and uniform transversal thickness can be obtained. Chinese invention patent ZL99808439.5 (entitled "Amorphous alloy metal ribbon and transformer's iron core with high lamination factor") discloses a method of manufacturing 170 mm wide amorphous alloy ribbons. In the present invention, through controlling cooling roll surface roughness under 0.005 mm and nozzle slot surface roughness under 0.005 mm, a 170 mm wide iron-based amorphous alloy broad ribbon with lamination factor of approx. 90% may be manufactured. However, in manufacturing of wider amorphous alloy broad ribbon, the temperature gradient at the nozzle may be larger, the overlong nozzle may be easily distorted so as to impact the consistency of transversal thickness of amorphous alloy broad ribbon, which seriously reduces the lamination factor of the amorphous alloy broad ribbon. The large heat stress may even crack the nozzle if in severe. Therefore it cannot meet the requirements of manufacturing high quality iron-based amorphous alloy broad ribbon above 220 mm in width.

In order to produce amorphous alloy ribbons continuously, it is required to synchronously wind the ribbons during continuous casting. Due to the relatively high temperature of the ribbon coil, the ribbon coil can hardly cool down immediately; structural relaxation may happen in the ribbon material and thus the ribbons may lose their excellent magnetic properties. In order to avoid obvious structural relaxation of the amorphous alloy ribbon, the coil temperature of the amorphous alloy ribbons apart from the cooling roll surface should be lower than a certain limit. The wider the amorphous alloy ribbon is, the slower the temperature drop after winding will be, the easier the broad ribbon coil structural relaxation occur, accordingly the lower the required winding temperature should be. For amorphous alloy ribbons below 213 mm in width, winding temperature may be set below 150° C. On the other hand, when the cooling ability of cooling roll system is fixed, the wider the amorphous alloy ribbon is, the heavier the heat duty on the cooling roll surface is, and the higher the winding temperature of the amorphous alloy ribbon will be. Therefore, the conflict between the rising ribbon temperature with increase of ribbon width and the requirement of broad ribbon on lowered winding temperature has become a challenge for manufacturing of ribbon above 213 mm in width.

CONTENTS OF INVENTION

Regarding the disadvantages of the prior art, the object of the present invention is to provide an iron-based amorphous alloy broad ribbon and a manufacturing method to manufacture 220~1000 mm wide iron-based amorphous alloy broad ribbon with excellent performance.

In order to achieve above object, the present invention provides the following technical solutions:

An iron-based amorphous alloy broad ribbon, which is manufactured with single-roll quenching method, wherein the width of broad ribbon is 220-1000 mm, the thickness is 0.02-0.03 mm, the transversal thickness deviation is smaller than ±0.002 mm, the lamination factor is larger than 0.84, the saturation magnetic-flux density is larger than 1.5 T, the iron loss is smaller than 0.20 W/kg under the conditions that the maximum magnetic-flux density is 1.3 T and the frequency is 50 Hz, the exciting power is smaller than 0.50 VA/kg, wherein the transversal flatness deviation of a cooling roll 4 for the manufacture process is smaller than 0.02 mm, the surface roughness Ra is smaller than 0.0005 mm.

The chemical composition of said iron-based amorphous alloy broad ribbon, in terms of mass percentage, is represented by a formula of $Fe_{100-x-y-z}Si_xB_yM_z$, wherein M is one or more selected from Ni, Co, Cr, Mn, Cu, V, Nb, Mo, W, Ta, Zr, Hf, C and P, x=0~6, y=1~5, z=0~5, and 5<x+y+z<12, the rest is inevitable impurities.

x=1.5~6, z=0.0~3.

In order to achieve the above object, the present invention further provides following technical solutions:

The said iron-based amorphous alloy broad ribbon is manufactured with single-roll quenching method involving the following steps:

① melt the raw materials in a smelting furnace 1 and form melt with uniform composition;

② pour the melt into tundish 2 to hold the melt;

③ pour the melt in the tundish 2 into the casting cup 3 and melt flows out from the nozzle slot at the bottom of the casting cup 3;

④ the melt flows out from said nozzle slot to the surface of high-speed rotating cooling roll 4 below the nozzle slot and is rapidly cooled into iron-based amorphous alloy broad ribbon;

⑤ said iron-based amorphous alloy broad ribbon is synchronously wound by winder 5 into broad ribbon coil 6 thereafter;

wherein, in Step ④, the width of said nozzle slot is 0.4~0.7 mm, the transversal width deviation is smaller than ±0.05 mm, the transversal flatness deviation of cooling roll 4 is smaller than 0.02 mm and the surface roughness Ra of cooling roll 4 is smaller than 0.0005 mm.

In step ④, said iron-based amorphous alloy broad ribbon is wound by step ⑤ after one or plurality of secondary cooling devices for further cooling after apart from the cooling roll 4.

The secondary cooling devices is an auxiliary cooling roll 7 or cooling media jet 8 or their combination.

The amorphous alloy broad ribbon forms a wrap angle of above 10° in terms of central angle on the auxiliary cooling roll 7.

Cooling water flows through the interior of the auxiliary cooling roll 7, and the cooling media jet 8 blows gas or volatile liquid media on the surface of said iron-based amorphous alloy broad ribbon.

There is a pre-processed arc on the nozzle surface of said casting cup 3 which forms a transversal consistent roll-to-nozzle gap together with the drum-shaped surface of the cooling roll in working state.

During the process of manufacturing iron-based amorphous alloy broad ribbon, the cooling roll surface is continuously repaired and cleaned to ensure the roll surface roughness Ra is smaller than 0.0005 mm throughout the casting.

The winding temperature of said iron-based amorphous alloy broad ribbon is lower than 120° C.

In comparison with the prior art, the advantages of the present invention is:

By controlling the transversal width deviation of the nozzle slot within ±0.05 mm, cooling roll surface roughness within 0.0005 mm and the flatness deviation of cooling roll surface within 0.02 mm, and by secondary cooling of the ribbons, the present invention enables the manufacture of an iron-based amorphous alloy broad ribbon with transversal thickness deviation smaller than ±0.002 mm, lamination factor larger than 0.84 and width within 220~1000 mm; the saturation magnetic-flux density of iron-based amorphous alloy broad ribbon is larger than 1.5 T; the iron loss is smaller than 0.20 W/kg under the conditions that the frequency is 50 Hz and the maximum magnetic-flux density is 1.3 T; the exciting power is smaller than 0.50 VA/kg under the conditions that the frequency is 50 Hz and the maximum magnetic-flux density is 1.3 T.

The reference signs of figures

| | | | |
|---|---|---|---|
| 1 | Induction smelting furnace | 2 | Tundish |
| 3 | Casting cup | 4 | Cooling roll |
| 5 | Winder | 6 | Broad ribbon coil |
| 7 | Auxiliary cooling roll | 8 | Cooling media jet |

DESCRIPTION OF EMBODIMENTS

The invention will be explained in greater detail in combination with figures and embodiments.

For the compositions of iron-based amorphous alloy in the present invention, Fe is the most important element and is the source of ferromagnetism of the material, whose content should be within 88-95% (mass percentage). Over low Fe content (<88%) will lead to the saturation magnetic-flux density of the alloy lower than 1.5 T and the alloy is no more useful. Over high Fe content (>95%) will make the alloy apart from eutectic point too much and reduce the glass-forming-ability of the alloy. In this case, the manufactured ribbon may be brittle and even the amorphous structure cannot be formed.

Si and B are indispensable in the iron-based amorphous alloy in the present invention. Both elements, called glass forming elements, play the role of forming alloy compositions close to eutectic point in coordination with Fe, reducing the melting point of the alloy and the critical cooling rate of forming amorphous alloy, and be easy to be super-cooled to form amorphous structure during cooling process. According to the present invention, the Si contents of 0~6% (mass percentage) and B contents of 1%~5% (mass percentage) are preferred.

Besides, other elements can also be added to iron-based amorphous alloy in the present invention up to 5% (mass percentage) to improve the specific performance of the alloy. For instance, addition of Ni or Co can increase saturation magnetic-flux density of alloy; addition of Cr, Mn, Cu, V, Nb, Mo, W, Ta, Zr or Hf may enhance crystallization temperature of the alloy and improve the thermal stability, however, too much additions will obviously reduce the curie temperature and saturation magnetic-flux density of the alloy. Therefore, in prefer, the total addition should be below 5% (mass content); the appropriate addition of elements such as C and P may improve the glass-forming-ability or processing ability of alloy.

In a word, the sum of the contents of Si, B and other added elements in iron-based amorphous alloy in the present invention is within 5%~12% (mass percentage), Fe contents is within 88%—95% (mass percentage). In addition there are extremely less inevitable impurities.

Figure 1:
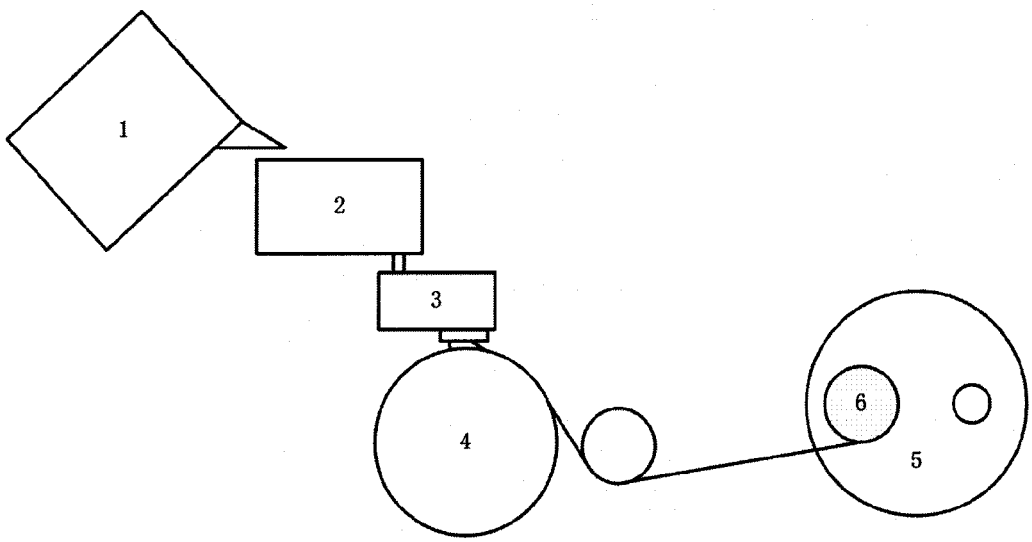
FIG. 1—diagrammatic drawing of technical principle of the manufacturing method of iron-based amorphous alloy broad ribbon of the present invention.

In the present invention iron-based amorphous alloy broad ribbon is manufactured with single-roll quenching method, the basic process includes raw material mixing, melting, ribbon casting and online winding. The process flow is shown in FIG. 1.

With regard to iron-based amorphous alloy broad ribbon in the present invention, pure iron, ferro-boron and ferro-silicon can be used as the raw materials, they are melted into the melt with uniform components in induction furnace or other kinds of furnace 1. Then the melt is poured into the tundish 2. The tundish 2 is used to hold the melt and to adjust production rhythm. In combination with other metallurgic methods in the prior art, the inclusions in melt can be afloat and removed so as to improve the quality of the master alloy melt.

After preparing the master alloy melt, the melt is poured into casting cup 3. There is a narrow long nozzle slot on the bottom of casting cup 3 to enable the melt to flow out. There is a high-speed rotating copper alloy cooling roll 4 below the nozzle slot. After flowing onto the cooling roll surface, the melt immediately spreads out and becomes a uniform film and then fast cools down into an amorphous alloy ribbon. At the same time the ribbon will be wound into ribbon coil 6 with winder 5.

When iron-based amorphous alloy broad ribbon is used in distribution transformers, it's expected that the amorphous alloy broad ribbon has high lamination factor to reduce the volume. "Lamination factor" refers to the rate of the true cross section area of the amorphous alloy materials and the cross section area of the contour shape when multiple layers of amorphous alloy broad ribbon are stacked together. Apparently, it's always expected that amorphous alloy broad ribbon should be as flat as possible, the transversal thickness deviation and defects should be as less as possible.

Figure 2:
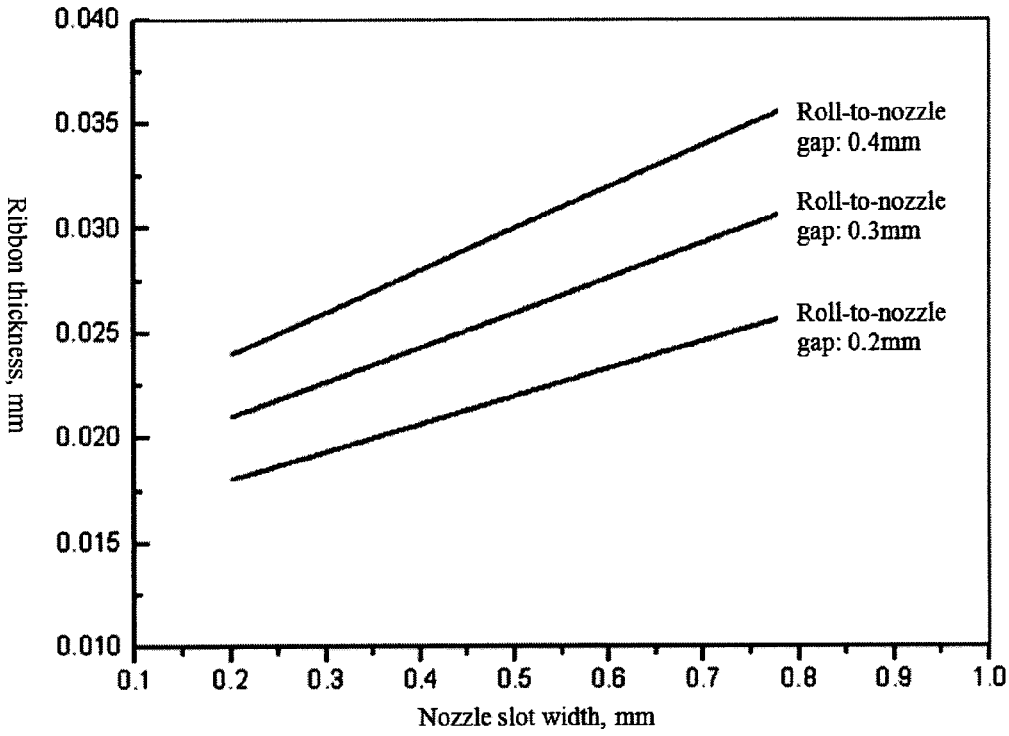
FIG. 2—relationship between width of the nozzle slot, roll-to-nozzle gap and thickness of amorphous alloy broad ribbon in said manufacturing method of the present invention.

In above process, the width of nozzle slot, roll-to-nozzle gap (distance between nozzle slot and cooling roll surface), rotate speed of cooling roll and the height of melt surface in casting cup 3 (static pressure) are the most important factors determining the thickness of amorphous alloy broad ribbon, while the consistency of the width of a nozzle slot and consistency of roll-to-nozzle gap are key factors to determine the consistency of transversal thickness deviation of amorphous alloy broad ribbon and then affect lamination factor of amorphous alloy broad ribbon. FIG. 2 shows the relationship between the thickness of amorphous alloy ribbon and the above process parameters acquired by a lot of experiments of amorphous alloy ribbon manufacturing process in the present invention.

According to the present invention, the length of the nozzle slot is the same as the width of the said amorphous alloy broad ribbon, while the width of nozzle slot is 0.4~0.7 mm. If the nozzle slot is narrower than 0.4 mm, the slot is easy to be jammed by inevitable inclusion particles in melt during the continuous casting of amorphous alloy broad ribbon so that amorphous alloy broad ribbon may be slit. If the nozzle slot is wider than 0.7 mm the melt flow through the nozzle slot is too large to cause the thickness of amorphous alloy broad ribbon exceeding the limit.

In order to obtain the required lamination factor of amorphous alloy broad ribbon, the transversal width deviation of nozzle slot smaller than ±0.05 mm is required. The experiments show that if the transversal width deviation of nozzle slot is bigger than ±0.05 mm, the melt flow will become non-uniform so as to cause non-uniform ribbon thickness and the lamination factor of the broad ribbon will be lower than 84%. The materials used for nozzle slot may be various precision ceramic materials such as alumina, boron nitride, SiC, graphite and so on. In order to prevent the nozzle slot from distorting during heating and consequently causing the change of the width of a nozzle slot, the nozzle slot may be combined with some high-strength refractory materials to enhance the anti-distortion ability of the nozzle slot or increase the thickness of nozzle slot materials appropriately to enhance the strength and ensure transversal width deviation of nozzle slot is smaller than ±0.05 mm.

The roll-to-nozzle gap is a key factor affecting thickness and thickness consistency of amorphous alloy broad ribbon. The present invention adopts the control range of roll-to-nozzle gap, 0.1~0.5 mm, to obtain 0.02~0.03 mm thick amorphous alloy broad ribbon. During production of amorphous alloy broad ribbon, the heat expansion of cooling roll may upheave the center of the roll surface so as to make the cooling roll surface drum-shaped. However if the bottom of the nozzle is still flat, the roll-to-nozzle gap will be inconsistent transversally so as to cause the non-uniform ribbon thickness. In order to prevent such phenomena, the bottom of the nozzle (the outlet end of the nozzle slot) may be preprocessed into a radian corresponding to the upheaved roll surface. In other words, measure the heat expansion of the cooling roll surface at different positions transversally during manufacturing of amorphous alloy broad ribbon in advance, and then process the nozzle bottom into a shape with the same radian as that of the expanded roll surface with high precision processing equipment. In this way the roll-to-nozzle gap can be consistent transversally during manufacturing of amorphous alloy broad ribbon.

Another factor influencing the consistency of roll-to-nozzle gap is the flatness and roughness of cooling roll surface. If there is transversal or longitudinal wave on the cooling roll surface, which means the change of roll-to-nozzle gap, the consistency of thickness of amorphous alloy broad ribbon transversally or longitudinal is impacted seriously so as to reduce the lamination factor of amorphous alloy broad ribbon. It is found in the experiments that, the transversal flatness deviation of cooling roll surface must be smaller than 0.02 mm to ensure the lamination factor of amorphous alloy broad ribbon exceeding 84%. Generally the relatively regular circumference of cooling roll surface may be acquired by turning, but general turning devices cannot ensure the transversal flatness of cooling roll surface. In order to ensure that the transversal flatness deviation of cooling roll surface is smaller than 0.02 mm, the high precision turning device must be used to make surface transversal flatness meeting the requirements.

The surface roughness Ra of the cooling roll surface should be smaller than 0.0005 mm all along during the process of continuous casting of amorphous alloy broad ribbon to ensure the lamination factor is larger than 84%. However, during the process of continuous casting of amorphous alloy ribbon, due to continuously suffering corrosion and heat impact of the melt, the cooling roll surface will gradually become deteriorated and show pits. In order to eliminate the defects on the roll surface in time, it's required to keep cleaning and repair the roll surface continuously; i.e. contacting and grinding the roll surface with high-speed rotated pan/wheel shaped grinding device made by sand wheel, sand paper or other abrading and polishing materials. The size of grinding particles on the grinding materials should be smaller than 280 meshes and the grinding device can also move along cooling roll transversally to ensure continuous cleaning and repairing of the roll surface within the width of the ribbon.

Due to high continuous casting speed of amorphous alloy ribbon up to approx. 20 msec, the manufactured amorphous alloy ribbon must be rolled synchronously in the continuous casting of the ribbon. Otherwise the ribbon will be stacked in a short time. In such cases, the winding efficiency will be reduced and there will be a lot of folds on the ribbon, so that the ribbon is easy to break and the lamination factor is lowered. There are many methods to wind amorphous alloy ribbon such as using the winder containing two or more spools on a rotatable plate which can realize not only synchronous winding of amorphous alloy ribbon, but also can change winding spools on line to ensure continuous production and winding of amorphous alloy ribbon.

After amorphous alloy ribbon is wound, the coil is still hot, and the heat in the interior of ribbon coil cannot dissipate immediately, so the temperature drops very slowly. Therefore the winding temperature of amorphous alloy ribbon should not be too high. It is proven that if the winding temperature of amorphous alloy is higher than 120° C., the ribbon will show irreversible structural relaxation so that the amorphous alloy ribbon will loss the excellent electromagnetic properties. Therefore the winding temperature of amorphous alloy ribbons should be lower than 120° C.

Figure 3:
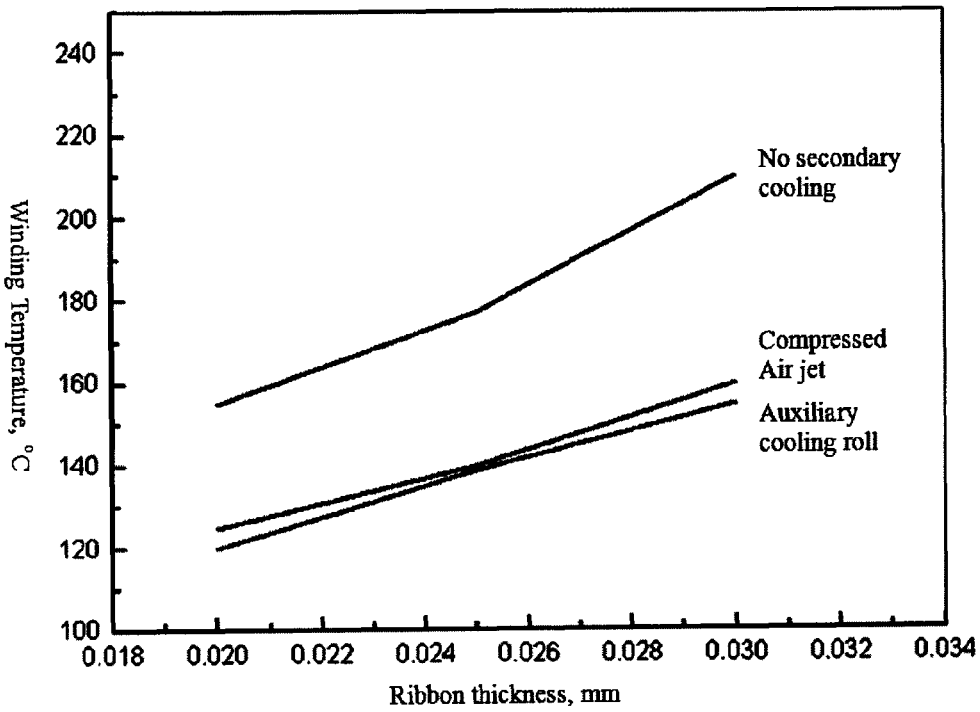
FIG. 3—relationship between winding temperature and thickness of the iron-based amorphous alloy broad ribbon in said manufacturing method of the present invention.

One of methods to ensure the winding temperature of amorphous alloy broad ribbon lower than 120° C. is to control the ribbon thickness below 0.03 mm in the present invention. According to this invention, under the conditions that the cooling ability of cooling roll system is practically stable, the thicker the ribbon is, the higher the winding temperature will be, as shown in FIG. 3. Therefore the present invention ensures the winding temperature lower than 120 through controlling the thickness of amorphous alloy broad ribbon within 0.03 mm. As mentioned before, the methods of controlling the thickness of amorphous alloy broad ribbon include controlling the width of a nozzle slot, roll-to-nozzle gap and the liquid level of the casting cup 3 and some other means. Although the methods in the present invention may control the thickness of the amorphous alloy broad ribbon below 0.02 mm, but the over thin ribbon will reduce the productivity.

Figure 4:
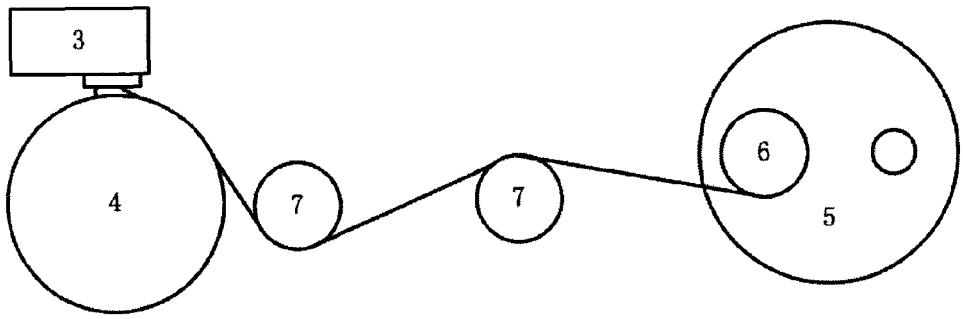
FIG. 4—diagrammatic drawing of secondary cooling of amorphous alloy broad ribbon of the present invention with an auxiliary cooling roll.
Figure 5:
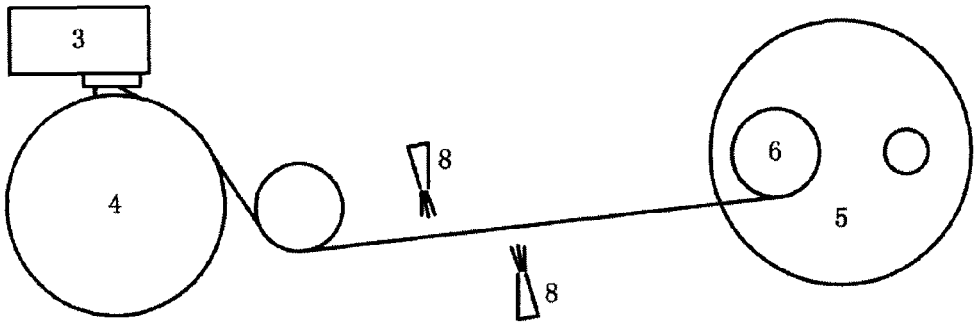
FIG. 5—diagrammatic drawing of the secondary cooling of amorphous alloy broad ribbon of the present invention with cooling media jet.

Another method to reduce winding temperature of the amorphous alloy broad ribbon in the present invention is that, a secondary cooling device is added between the peeling point where the amorphous alloy broad ribbon is apart from the cooling roll surface and the winder 5. One of methods is to install one or more metal auxiliary cooling rolls 7, as shown in FIG. 4. The arrangement of relative height among the auxiliary cooling roll 7 and the cooling roll 4 and the winder 5 should enable amorphous alloy broad ribbon to form an arc length whose wrap angle with central angle above 10° on the auxiliary cooling roll 7. In other words, the contact area of the ribbon on the auxiliary cooling roll 7 forms a central angle above 10°. In such a way the ribbon is further cooled down. In order to strengthen the secondary cooling effect, cooling water may go through the interior of the auxiliary cooling roll 7. Another method is to blow gas or volatile liquid media on the surface of amorphous alloy broad ribbon between the puddle and winder 5 with a jet 8 to further cool down amorphous alloy broad ribbon; the suitable media here include air, argon, nitrogen, water and ethanol. The blown media may be any one of the above media or their mixture. Several media may be blown at the same time; the media temperature may be equal to, higher or lower than the room temperature, as shown in FIG. 5. Through secondary cooling of the broad ribbon, the ribbon temperature drops obviously, as shown in FIG. 3.

Through implementing technical solutions of the present invention, the manufactured iron-based amorphous alloy broad ribbon shows excellent property. The width of said iron-based amorphous alloy broad ribbon is 220~1000 mm, the thickness is 0.02~0.03 mm, the transversal thickness deviation is smaller than ±0.002 mm, the lamination factor is larger than 0.84, the saturation magnetic-flux density is larger than 1.5 T and, the iron loss is smaller than 0.20 W/kg and the exciting power is smaller than 0.50 VA/kg under the conditions that the frequency is 50 Hz and the maximum magnetic-flux density is 1.3 T.

Here, within the scope of the chemical compositions of said iron-based amorphous alloy, different iron-based amorphous alloy compositions are selected respectively and then amorphous alloy broad ribbon are cast with single-roll quenching method. The main process parameters include: the temperature of master alloy melt is within 1300~1450° C., the nozzle slot width is 0.4~0.7 mm, the width deviation of a nozzle slot is smaller than ±0.05 mm, the liquid level of melt in casting cup 3 is 300~550 mm, the linear speed of circumference of cooling roll is 15~25 m/sec, the transversal flatness deviation of exterior surface of cooling roll is smaller than 0.02 mm and roll-to-nozzle gap is within 0.1~0.4 mm. During manufacturing iron-based amorphous alloy broad ribbon, the roll surface roughness Ra is smaller than 0.0005 mm throughout the casting by keep repairing and cleaning the cooling roll surface.

The process parameters and properties of amorphous alloy broad ribbon are shown in table 1 and 2. The result shows that, for iron-based amorphous alloy broad manufactured by above process, the thickness is within 0.02~0.03 mm, thickness transversal deviation is within ±0.002 mm, lamination factor is bigger than 0.84, saturation magnetic-flux density is bigger than 1.5 T, the iron loss is smaller than 0.20 W/kg and the exciting power is smaller than 0.50 VA/kg under the conditions that the frequency is 50 Hz and the maximum magnetic-flux density is 1.3 T. Besides, when the process parameters go beyond the scope of the present invention, the manufactured iron-based amorphous alloy broad ribbon may have defects such as embrittlement, high winding temperature, low lamination factor or deteriorated magnetic properties.

Above implementation cases are just used for explain the present invention, not for limitations to the present invention. Technical persons in relevant technical field may make changes and transformations within the frame of the spirit and scope of the present invention. Therefore, all equivalent technical solutions also belong to the scope of the present invention. The patent protection scope of the present invention should be limited by the claims attached.

TABLE 1

Main process parameters adopted in iron-based amorphous alloy broad ribbon in embodiments of the present invention

| No. | Alloy composition (mass percentage) | Master alloy melt temperature (° C.) | Length of nozzle slot (mm) | Width of nozzle slot (mm) | Liquid level of casting cup (mm) | Roll-to-nozzle gap (mm) | Linear speed of cooling roll surface (m/sec) | Transversal flatness deviation of cooling roll surface (mm) | Roughness of cooling roll surface Ra (mm) | Secondary cooling |
|---|---|---|---|---|---|---|---|---|---|---|
| 1 | Fe91.8Si5.5B2.5Mn0.2 | 1350 | 431 | 0.52~0.54 | 320 ± 5 | 0.25 ± 0.01 | 21 ± 0.05 | 0.015 | 0.00043 | Compressed air |
| 2 | Fe94Si1.5B2.9C1.6 | 1320 | 285 | 0.45~0.46 | 480 ± 5 | 0.32 ± 0.01 | 19 ± 0.05 | 0.010 | 0.00035 | Auxiliary cooling roll |

TABLE 1-continued

Main process parameters adopted in iron-based amorphous alloy broad ribbon in embodiments of the present invention

| No. | Alloy composition (mass percentage) | Master alloy melt temperature (° C.) | Length of nozzle slot (mm) | Width of nozzle slot (mm) | Liquid level of casting cup (mm) | Roll-to-nozzle gap (mm) | Linear speed of cooling roll surface (m/sec) | Transversal flatness deviation of cooling roll surface (mm) | Roughness of cooling roll surface Ra (mm) | Secondary cooling |
|---|---|---|---|---|---|---|---|---|---|---|
| 3 | Fe92Si5.4B2.4Ni0.1Mn0.1 | 1380 | 950 | 0.68~0.69 | 270 ± 5 | 0.18 ± 0.01 | 22 ± 0.05 | 0.003 | 0.00050 | Auxiliary cooling roll |
| 4 | Fe91.9Si5.5B2.5C0.05Mn0.05 | 1410 | 341 | 0.60~0.61 | 280 ± 5 | 0.20 ± 0.01 | 22 ± 0.05 | 0.015 | 0.00045 | Auxiliary cooling roll |
| 5 | Fe91.7Si5.3B3 | 1400 | 981 | 0.50~0.52 | 435 ± 5 | 0.25 ± 0.01 | 20 ± 0.05 | 0.018 | 0.00030 | Auxiliary cooling roll |
| 6 | Fe88Si6B2Cu1Nb3 | 1370 | 341 | 0.58~0.59 | 375 ± 5 | 0.25 ± 0.01 | 21 ± 0.05 | 0.009 | 0.00035 | Compressed air |
| 7 | Fe92Si5.6B2.4 (comparison case) | 1350 | 300 | 0.80~0.81 | 240 ± 5 | 0.15 ± 0.01 | 20 ± 0.05 | 0.040 | 0.00085 | None |
| 8 | Fe92Si5.6B2.4(comparison case) | 1350 | 431 | 0.34~0.34 | 480 ± 5 | 0.35 ± 0.01 | 20 ± 0.05 | 0.050 | 0.00062 | None |

TABLE 2

Properties of iron-based amorphous alloy broad ribbon in embodiments of the present invention

| No. | Alloy composition (mass percentage) | Winding temperature (° C.) | Ribbon width (mm) | Ribbon thickness (mm) | Lamination factor (%) | Saturation magnetic-flux density (T) | Toughness of broad ribbon | Iron loss (W/kg) | Exciting power (VA/kg) |
|---|---|---|---|---|---|---|---|---|---|
| 1 | Fe91.8Si5.5B2.5Mn0.2 | 160 | 430.1 | 0.028~0.029 | 87.6 | 1.59 | Excellent | 0.14 | 0.21 |
| 2 | Fe94Si1.5B2.9C1.6 | 120 | 284.4 | 0.021~0.023 | 85.5 | 1.64 | Excellent | 0.10 | 0.43 |
| 3 | Fe92Si5.4B2.4Ni0.1Mn0.1 | 135 | 948.5 | 0.022~0.024 | 88.0 | 1.61 | Excellent | 0.12 | 0.31 |
| 4 | Fe91.9Si5.5B2.5C0.05Mn0.05 | 155 | 340 | 0.027~0.029 | 86.9 | 1.59 | Excellent | 0.13 | 0.28 |
| 5 | Fe91.7Si5.3B3 | 135 | 980.2 | 0.025~0.026 | 89.9 | 1.58 | Excellent | 0.12 | 0.29 |
| 6 | Fe88Si6B2Cu1Nb3 | 165 | 340.3 | 27.0~27.6 | 85.7 | 1.52 | Excellent | 0.17 | 0.48 |
| 7 | Fe92Si5.6B2.4 (comparison case) | 240 | 298.8 | 0.029~0.034 | 83.2 | 1.40 | Bad | 0.32 | 1.98 |
| 8 | Fe92Si5.6B2.4 (comparison case) | 215 | 299.3 | 0.019~0.023 | 81.7 | 1.58 | Excellent | 0.28 | 0.64 |

The invention claimed is:

1. An iron-based amorphous alloy broad ribbon, which is manufactured with single-roll quenching method, wherein the width of broad ribbon is 220-1000 mm, the thickness is 0.02-0.03 mm, the transversal thickness deviation is smaller than ±0.002 mm, a lamination factor is larger than 0.84, the saturation magnetic-flux density is larger than 1.5 T, the iron loss is smaller than 0.20 W/kg under the conditions that the maximum magnetic-flux density is 1.3 T and the frequency is 50 Hz, an exciting power is smaller than 0.50 VA/kg, wherein the transversal flatness deviation of a cooling roll (4) for manufacture process is smaller than 0.02 mm, the surface roughness Ra is smaller than 0.0005 mm, wherein the lamination factor refers to a ratio of true cross section area of amorphous alloy materials and cross section area of contour shape when multiple layers of amorphous alloy broad ribbon are stacked together, and wherein the exciting power refers to a product of exciting current and voltage of winding around a magnetic core when the core is excited to a pre-determined magnetic flux density by the winding.

2. The iron-based amorphous alloy broad ribbon as claimed in claim 1, wherein the chemical composition of said iron-based amorphous alloy broad ribbon, in terms of mass percentage, is represented by a formula of $Fe_{100-x-y-z}Si_xB_yM_z$, wherein M is one or more selected from Ni, Co, Cr, Mn, Cu, V, Nb, Mo, W, Ta, Zr, Hf, C and P, x=0~6, y=1~5, z=0~5, and 5<x+y+z<12, the rest are inevitable impurities.

3. The iron-based amorphous alloy broad ribbon as claimed in claim 2, wherein x=1.5~6, z=0.05~3.

4. A manufacturing method of iron-based amorphous alloy broad ribbon as claimed in claim 1, which adopt single-roll quenching method, including steps as follows:

① melt raw materials in a smelting furnace (1) and form melt with uniform composition;

② pour the melt into tundish (2) to hold the melt;

③ pour the melt in tundish (2) into the casting cup (3) and melt flows out from the nozzle slot at the bottom of a casting cup (3);

④ the melt flows out from said nozzle slot to the surface of rotating cooling roll (4) below a nozzle slot and is rapidly cooled into iron-based amorphous alloy broad ribbon;

⑤ said iron-based amorphous alloy broad ribbon is synchronously wound by a winder (5) into broad ribbon coil (6) thereafter;

wherein, in Step ④, the width of said nozzle slot is 0.4~0.7 mm, transversal width deviation is smaller than ±0.05 mm, the transversal flatness deviation of cooling roll (4) is smaller than 0.02 mm and the surface roughness Ra of cooling roll (4) is smaller than 0.0005 mm.

5. The manufacturing method of said iron-based amorphous alloy broad ribbon as claimed in claim 4, wherein in step ④, said iron-based amorphous alloy broad ribbon goes through one or plurality of secondary cooling devices for further cooling after said ribbon is peeled off the cooling roll (4).

6. The manufacturing method of said iron-based amorphous alloy broad ribbon as claimed in claim 5, wherein said secondary cooling devices comprise an auxiliary cooling roll (7) or cooling media jet (8) or their combination.

7. The manufacturing method of said iron-based amorphous alloy broad ribbon as claimed in claim 6, wherein said amorphous alloy broad ribbon forms a wrap angle of above 10° in terms of central angle on the auxiliary cooling roll (7).

8. The manufacturing method of said iron-based amorphous alloy broad ribbon as claimed in claim 6, wherein cooling water flows through the interior of the auxiliary cooling roll (7), and the cooling media jet (8) blows gas or volatile liquid media on the surface of said iron-based amorphous alloy broad ribbon.

9. The manufacturing method of said iron-based amorphous alloy broad ribbon as claimed in claim 4, wherein there is a pre-processed arc on a nozzle surface on said casting cup (3) which forms a transversal consistent roll-to-nozzle gap together with a drum-shaped surface of cooling roll in working state.

10. The manufacturing method of said iron-based amorphous alloy broad ribbon as claimed in claim 4, wherein during the process of manufacturing iron-based amorphous alloy broad ribbon, the cooling roll surface is continuously repaired and cleaned to ensure the roll surface roughness Ra is smaller than 0.0005 mm throughout casting.

11. The manufacturing method of said iron-based amorphous alloy broad ribbon as claimed in claim 4, wherein the winding temperature of said iron-based amorphous alloy broad ribbon is lower than 120° C.

* * * * *